US007944415B2

(12) United States Patent
Jang et al.

(10) Patent No.: US 7,944,415 B2
(45) Date of Patent: May 17, 2011

(54) ORGANIC LIGHT EMITTING DIODE DISPLAY DEVICE AND A DRIVING METHOD THEREOF

(75) Inventors: Jin Jang, Seoul (KR); Ji-Ho Hur, Seoul (KR); Se-Hwan Kim, Seoul (KR); Youn-Duck Nam, Seoul (KR)

(73) Assignee: Silicon Display Technology Co., Ltd., Seoul (KR)

( * ) Notice: Subject to any disclaimer, the term of this patent is extended or adjusted under 35 U.S.C. 154(b) by 1136 days.

(21) Appl. No.: 11/396,925

(22) Filed: Apr. 3, 2006

(65) Prior Publication Data

US 2007/0024547 A1 Feb. 1, 2007

(30) Foreign Application Priority Data

Jul. 27, 2005 (KR) ..... 10-2005-0068514

(51) Int. Cl.
*G09G 3/30* (2006.01)

(52) U.S. Cl. ..... 345/77

(58) Field of Classification Search ..... 345/76–83; 315/169.3; 348/800; 313/504
See application file for complete search history.

(56) References Cited

U.S. PATENT DOCUMENTS

| | | | | |
|---|---|---|---|---|
| 6,982,687 | B2 * | 1/2006 | Kim et al. | 345/76 |
| 2001/0052597 | A1 * | 12/2001 | Young et al. | 257/59 |
| 2002/0186188 | A1 * | 12/2002 | Cok | 345/82 |
| 2003/0142047 | A1 * | 7/2003 | Inoue et al. | 345/82 |
| 2003/0160263 | A1 * | 8/2003 | Hiroshima | 257/151 |
| 2003/0169247 | A1 * | 9/2003 | Kawabe et al. | 345/204 |
| 2004/0056257 | A1 * | 3/2004 | Sakamoto et al. | 257/79 |
| 2004/0145547 | A1 * | 7/2004 | Oh | 345/76 |
| 2005/0007320 | A1 * | 1/2005 | Smith et al. | 345/77 |
| 2005/0017934 | A1 * | 1/2005 | Chung et al. | 345/82 |
| 2005/0030264 | A1 * | 2/2005 | Tsuge et al. | 345/76 |
| 2005/0200294 | A1 * | 9/2005 | Naugler et al. | 315/149 |
| 2005/0285823 | A1 * | 12/2005 | Kimura et al. | 345/76 |

FOREIGN PATENT DOCUMENTS

JP 2003-076327 3/2003

OTHER PUBLICATIONS

Jang; "Circuit and Method for Driving Organic Light Emitting Diode" U.S. Appl. No. 11/396,932; filed Apr. 3, 2006.
Jang; "Unevenness Detecting Apparatus for Compensating for Threshold Voltage and Method Thereof" U.S. Appl. No. 11/396,951; filed Apr. 3.2006.

* cited by examiner

*Primary Examiner* — Chanh Nguyen
*Assistant Examiner* — Robert M Stone
(74) *Attorney, Agent, or Firm* — Ladas & Parry LLP

(57) ABSTRACT

Disclosed are an Organic Light Emitting Diode (OLED) display device having a pixel circuit which use a thin film transistor (TFT) as an active device and a driving method thereof. The OLED display device can constantly obtain luminance of the light emitting elements by elapsed time, because the brightness of the pixel for the signal voltage is not varied by a characteristic variance of the transistor (e.g., a driving element) and the OLED. Accordingly, the OLED display device according to the present invention can minimizes the variance of the pixel brightness due to deterioration of the transistor and the OLED caused by usage for a long time and increase life span of the display device. Further, the OLED display device can display high quality of the image even in case of the high precision display, because it is controlled to flow the current to OLED included in each pixel.

12 Claims, 4 Drawing Sheets

ORGANIC LIGHT EMITTING DIODE DISPLAY DEVICE AND A DRIVING METHOD THEREOF

CLAIM FOR PRIORITY

This application claims priority to Korean Patent Application No. 10-2005-0068514 filed on Jul. 27, 2005, in the Korean Intellectual Property Office (KIPO), the entire contents of which are hereby incorporated by reference.

BACKGROUND

1. Field of the Invention

Example embodiments of the present invention relates in general to the field of an Organic Light Emitting Diode (OLED) display device having a pixel circuit and a driving method thereof, and more specifically to an Organic Light Emitting Diode (OLED) display device having a pixel circuit which use a thin film transistor (TFT) as an active device and a driving method thereof.

2. Description of the Related Art

Presently, the OLED display device as a thin-film type display device can apply a Passive Matrix (PM) driving method and hence an Active Matrix (AM) driving method, in the same method as the LCD in which has been used widely and commercially.

The passive matrix driving method can have a simple structure and apply data exactly to each pixel. However, the passive matrix driving method is difficult to be applied to a large screen and a high-precision display. Accordingly, the development of the active matrix driving method has been actively proceeding.

A pixel circuit of the OLED display device will be now explained with reference to FIGS. 1 and 2 according to a conventional active matrix driving method.

FIG. 1 is a schematic diagram illustrating the OLED display device having a pixel circuit according to a conventional active matrix method.

Referring to FIG. 1, in the OLED display device, a plurality of scan lines ($X_1$, $X_2$, $X_3$, . . . , $X_n$) for selecting and non-selecting the pixels 30 for a desired scan cycle (e.g., a frame period according to a NTSC standard) and a plurality of data lines ($Y_1$, $Y_2$, $Y_3$, . . . , $Y_n$) for supplying luminance information so as to drive the pixels 30 are arranged in a matrix type. The pixels 30 are arranged in each intersection portion in which the scan lines and the data lines are arranged in the matrix type. The respective pixels 30 are composed of a pixel circuit.

The scan lines ($X_1$, $X_2$, $X_3$, . . . , $X_n$) are connected to a scan line driving circuit 20, and the data lines ($Y_1$, $Y_2$, $Y_3$, . . . , $Y_n$) are connected to a data line driving circuit 10. A desired image can be represented by selecting sequentially the scan lines ($X_1$, $X_2$, $X_3$, . . . , $X_n$) by the data line driving circuit 10, supplying a voltage (or current) of the luminance information from the data lines ($Y_1$, $Y_2$, $Y_3$, . . . , $Y_n$) by the data line driving circuit 10, and filling repeatedly the voltage of the luminance information.

In this case, the passive matrix type OLED display device emits light only while light-emitting elements included in the respective pixels 30 are being selected, while an active matrix type OLED display device continuously performs the light emission of the light-emitting elements even after the voltage filling of the luminance information is finished.

Thus, in the large screen and high-precision display, the active matrix type OLED display device is more superior to the passive matrix type OLED display device because the driving current level of the light-emitting element is low.

Hereinafter, a driving operation of the OLED display device having the plurality of pixels 30 will be explained in detailed.

First, the scan line driving circuit 20 selects one XN of the scan lines ($X_1$, $X_2$, $X_3$, . . . , $X_n$) and transmits a selecting signal. In the data line driving circuit 10, the data of the luminance information is transmitted to pixels arranged in transverse direction via the data lines ($Y_1$, $Y_2$, $Y_3$, . . . , $Y_n$).

Then, the scan line driving circuit 20 transmits a non-selected signal to the selected scan line XN, and then selects the next scan line ($X_{N+1}$) so as to transmit the select signal. If the selection signal and the non-selected signal are sequentially transmitted to the scan line, the OLED display device can obtain a desired display by transmitting repeatedly the data.

FIG. 2 is a circuit diagram illustrating a conventional pixel circuit according to an active matrix method.

Referring to FIG. 2, a pixel circuit for driving a pixel 30 includes two NMOS transistors T1 and T2, and an OLED. The pixel circuit includes the OLED, a first transistor T1 for controlling a current, a second transistor T2, and a capacitor $C_S$.

A source terminal of the first transistor T1 is connected to a positive pole (i.e., anode), and a drain terminal thereof is connected to a positive power source ($V_{DD}$). A gate terminal of the second transistor T2 is connected to a scan line $X_N$, and a drain terminal thereof is connected to a data line $Y_M$, and a source terminal thereof is connected to the gate terminal of the first transistor T1 and the capacitor $C_{ST}$.

A negative pole (i.e., cathode) of the OLED is connected to a negative supply source ($V_{SS}$). Thus, a current of the OLED is controlled by applying a voltage of the data line $Y_M$ to the gate terminal of the first transistor T1 via the second transistor T2.

Hereinafter, a driving operation of the pixel circuit will be explained.

When the gate terminal of the second transistor T2 receives a selection signal from the scan line $X_N$, the second transistor T2 is turned on. At this time, a voltage corresponding to luminance information, which is applied to the data line $Y_M$ by the data line driving circuit, is transmitted to the gate terminal of the first transistor T1 via the second transistor T2, and the luminance information voltage is stored in the capacitor $C_{ST}$.

Accordingly, even while the second transistor T2 is turned off by receiving the non-selected signal supplied from the scan line XN over one frame period, the voltage of the gate terminal of the first transistor T1 is constantly hold by the capacitor $C_{ST}$ and thus the current flowing to the OLED via the first transistor T1 is constantly maintained.

As such, in conventional pixel circuit, since the current flowing to the OLED is the same as the current flowing from the drain terminal of the first transistor T1 to the source terminal thereof, the current is controlled by the voltage of the gate terminal of the first transistor T1. However, the current may be different from the magnitude of a desired current due to a characteristic deterioration caused by operation of the first transistor T1 for a long time.

A thin film transistor used in the display device is an active element suitable for the large screen and high precision display. However, even though the thin film transistor is formed on the same substrate, there is a problem that a threshold voltage of the thin film transistor is increased by several hundreds of □ or more than 1 Volt according to time variation.

For example, even though a same signal potential Vw is supplied to the gate of the thin film transistor in different time (e.g., several month later), if the threshold voltage of the transistor included in each pixel is different, the current value flowing to the OLED deviates from a value necessary for each pixel, and thus long life span necessary for the display device can not be expected.

The increasing of the threshold voltage for varying the current flowing to the OLED can not avoid according as the time flows. The characteristic deterioration produced by utilizing the display device for a long time causes an initial value to be greatly varied and the deterioration of the OLED causes a luminance to be greatly varied. This enables the quality of definition or brightness of the display device to be greatly varied, thereby decreasing life span of the display device.

FIG. 3 is a circuit diagram illustrating a voltage compensating circuit according to a conventional active matrix method, and FIG. 4 is a timing chart illustrating a driving of the voltage compensating circuit according to the conventional active matrix method.

Referring to FIGS. 3 and 4, the conventional voltage compensating circuit usually compensates a threshold voltage of the first transistor T1, but does not compensate a field effect mobility of the first transistor T1 and a characteristic deterioration of the OLED.

FIG. 5 is a circuit diagram illustrating a current compensating pixel circuit and a timing chart for driving the circuit according to a conventional general active matrix method.

Referring to FIG. 5, the current compensating circuit compensates a current-voltage characteristic variance of the first transistor T1 and the OLED, but does not compensate an efficiency variance of the OLED.

SUMMARY

Accordingly, the present invention is provided to substantially obviate one or more problems due to limitations and disadvantages of the related art.

Example embodiments of the present invention provide an OLED display device having a pixel circuit for sensing light emitted from the OLED using a photo sensor and applying a driving current according as the sensed value is sent by feedback to an input signal so as to represent a constant luminance with respect to the input signal irrespective of an increasing of a threshold voltage used in an active matrix and a characteristic deterioration of the OLED.

In some example embodiments, an OLED display device includes a scan line driving circuit configured to apply sequentially a selecting signal or a non-selecting signal to a plurality of scan lines; a data line driving circuit configured to apply a voltage corresponding to image information to a plurality of data lines; and an OLED having a pixel circuit arranged in each point where the scan lines and the data lines are intersected. The pixel circuit includes: an OLED D1 having two terminals; a first transistor of which a source terminal is connected to an anode terminal of the OLED, and a drain terminal is connected to a power supply, for providing a current to the OLED according to an applied voltage; a second transistor of which a gate terminal is connected to a first scan line and a drain terminal is connected to the data line; a third transistor of which a drain terminal is connected to the source terminal of the first transistor and the power supply, and a gate terminal is connected to a first scan line of former terminal, and a source terminal is connected to the gate terminal of the first transistor; a fourth transistor of which a drain terminal is connected to the source terminal of the second transistor, a source terminal is connected to a common electrode, and a gate terminal is connected to a second scan line; a fifth transistor of which a drain terminal is connected to the gate terminal of the first transistor and the source terminal of the third transistor, and a gate terminal is connected to the second scan line and the gate terminal of the fourth transistor; a capacitor of which one terminal is connected to the gate terminal of the first transistor, the source terminal of the third transistor and the drain terminal of the fifth transistor, and the other terminal is connected to the source terminal of the second transistor and the drain terminal of the fourth transistor; and an photo sensor of which one terminal is connected to the drain terminal of the fifth transistor, and the other terminal is connected to a common electrode.

Preferably, the photo sensor may be a thin film transistor type photo sensor using a photo leak current of the thin film transistor or a photodiode, and be formed of amorphous silicon, polycrystalline or crystalline silicon.

Preferably, the transistor may be amorphous silicon thin film transistor, or polycrystalline or crystalline thin film transistor.

Preferably, the transistor may be an inverted-staggered type that a gate is firstly formed on an insulator substrate.

In other example embodiments, a driving method of an OLED display device including a scan line driving circuit configured to apply sequentially a selecting signal or a non-selecting signal to a plurality of scan lines; a data line driving circuit configured to apply a voltage corresponding to image information to a plurality of data lines; and a pixel circuit arranged in each point where the scan lines and the data lines are intersected, includes: enabling the selecting signal to be transmitted to a gate terminal of a third transistor via a first scan line of former terminal (i.e. $(N-1)^{th}$ first scan line) so as to turn on the third transistor to increase a pixel voltage V1, and enabling a fourth and fifth transistor to be turned on according as the first scan line of the former terminal (i.e. $(N-1)^{th}$ first scan line) is selected and simultaneously a second scan line (i.e., $N^{th}$ scan line) is selected; enabling the OLED to emitting light by the increasing of the pixel voltage and enabling the pixel voltage to be maintained to a constant voltage according as a leak current of an photo sensor is increased; enabling the third transistor to be turned off by applying the non-selecting signal to the first scan line of the former terminal (i.e. $(N-1)^{th}$ first scan line), enabling the photo sensor to produce an photo current until the OLED is turned off so as to decrease gradually the pixel voltage, and setting the pixel voltage, when the non-selecting signal is applied to the second scan line, to the gate terminal of the first transistor; enabling the second transistor to be turned on by applying the selecting signal via a first scan line (i.e., $N^{th}$ first scan line), storing a voltage ($V_{data}$) corresponding to luminance information transmitted from the data line via the turned on second transistor and simultaneously varying the voltage of the gate terminal of the first transistor; and enabling the first transistor to be turned on according as the voltage is applied to the gate terminal of the first transistor and emitting light from the OLED by flowing constant current to the OLED.

Preferably, the photo sensor may be a photo diode or a thin film transistor type photo sensor using a photo leak current of the thin film transistor.

Preferably, after the non-selecting signal is applied to the first scan line (i.e., $N^{th}$ first scan line), the voltage of the gate terminal of the first transistor and the current flowing to the OLED is constantly maintained by the voltage stored in the capacitor for 1 frame period.

The pixel voltage V1 for the 1 frame period is to add a voltage $V_{th}$ set to the gate terminal of the first transistor while turning off the OLED to a voltage $V_{data}$ corresponding to luminance information transmitted through the data line.

BRIEF DESCRIPTION OF THE DRAWINGS

Example embodiments of the present invention will become more apparent by describing in detail example embodiments of the present invention with reference to the accompanying drawings, in which.

DESCRIPTION OF EXAMPLE EMBODIMENTS OF THE PRESENT INVENTION

Figure 1:
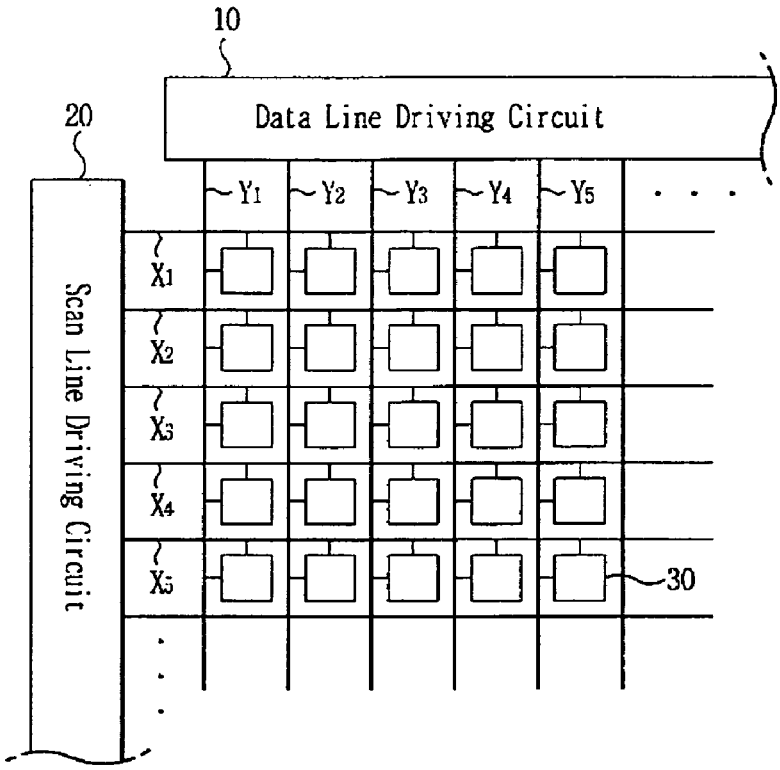
FIG.1 PRIOR ART
FIG. 1 is a schematic diagram illustrating an OLED display device having a pixel circuit according to a conventional active matrix method.
Figure 2:
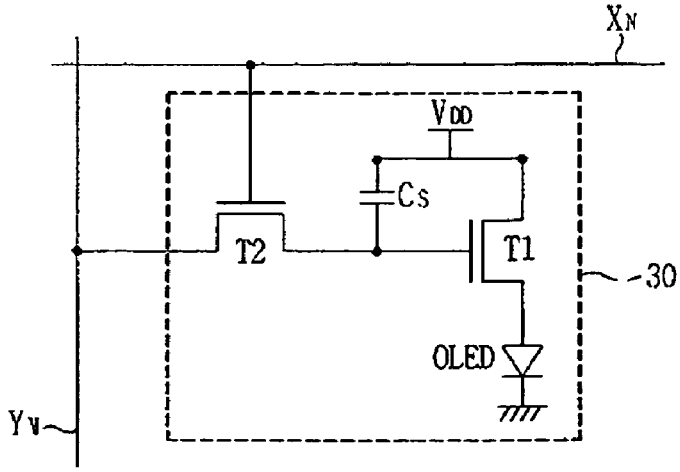
FIG.2 PRIOR ART
FIG. 2 is a circuit diagram illustrating a conventional pixel circuit according to an active matrix method.
Figure 3:
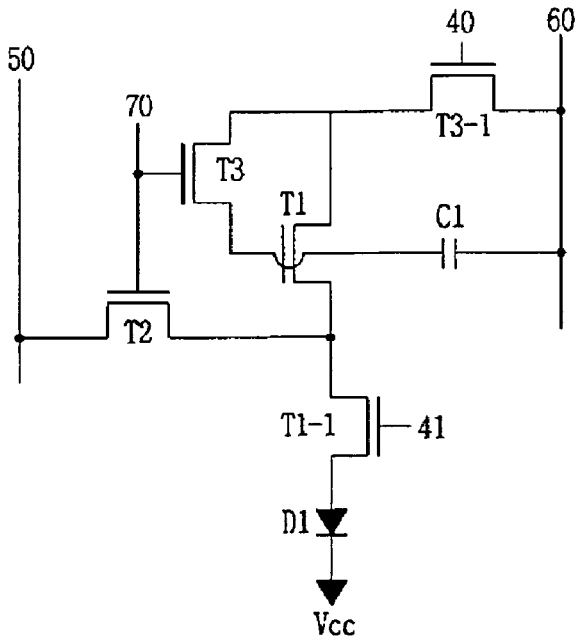
FIG.3 PRIOR ART
FIG. 3 is a circuit diagram illustrating a conventional voltage compensating circuit according to an active matrix method.
Figure 4:
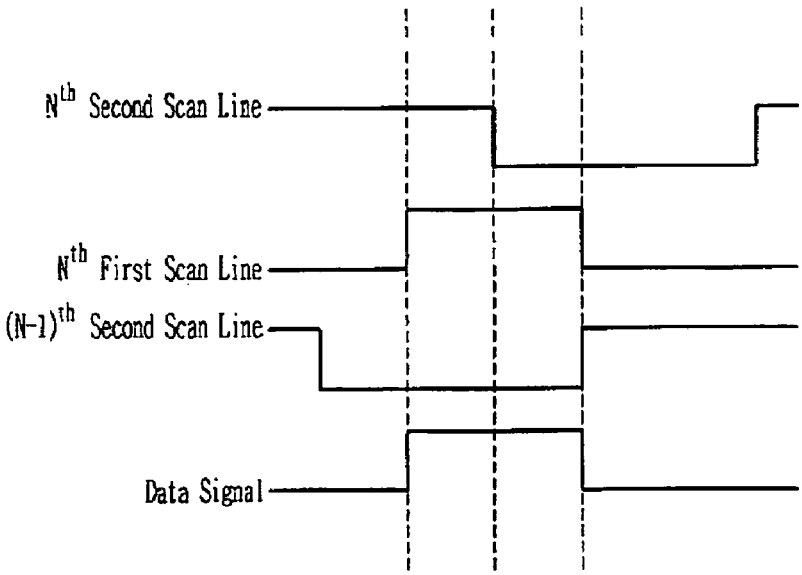
FIG.4 PRIOR ART
FIG. 4 is a timing chart explaining a driving operation of the conventional voltage compensating circuit according to an active matrix method.
Figure 5:
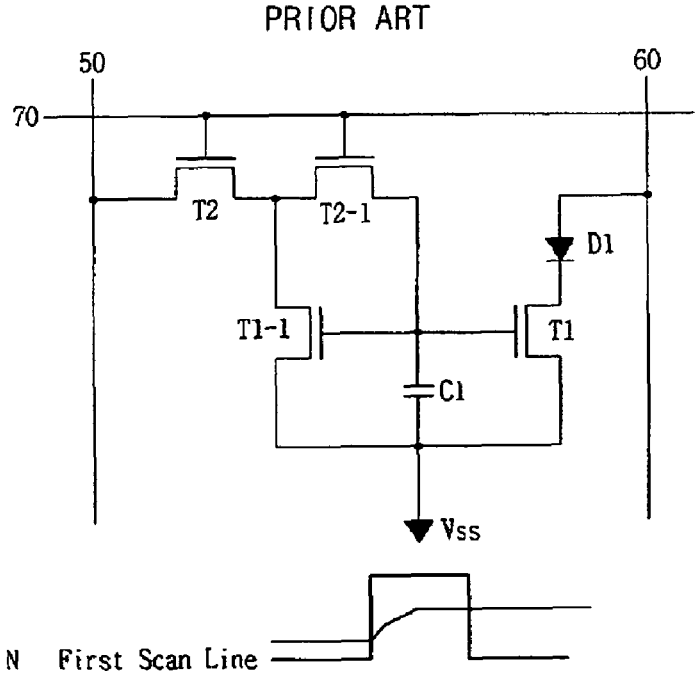
FIG. 5 is a circuit diagram illustrating the conventional voltage compensating circuit according to an active matrix method and a timing chart explaining a driving operation thereof.

Example embodiments of the present invention are disclosed herein. However, specific structural and functional details disclosed herein are merely representative for purposes of describing example embodiments of the present invention, however, example embodiments of the present invention may be embodied in many alternate forms and should not be construed as limited to example embodiments of the present invention set forth herein.

Accordingly, while the invention is susceptible to various modifications and alternative forms, specific embodiments thereof are shown by way of example in the drawings and will herein be described in detail. It should be understood, however, that there is no intent to limit the invention to the particular forms disclosed, but on the contrary, the invention is to cover all modifications, equivalents, and alternatives falling within the spirit and scope of the invention. Like numbers refer to like elements throughout the description of the figures.

Hereinafter, an OLED display device and a driving method thereof of the present invention will be described in detail with reference to the accompanying drawings. The embodiment will be explained in detail for enabling people who have common intellects in a corresponding field to execute the present invention.

The present invention forms a thin film transistor array of the OLED composed of amorphous silicon thin film transistor on an insulating substrate. In this case, the amorphous silicon thin film transistor on the insulating substrate is used as a switching element, and a photo sensor detects light of the OLED and sends feedback to a pixel signal.

According to the present invention, the photo sensor may be a thin film transistor type photo sensor using a photo leak current of the thin film transistor or a photodiode, the driving transistor may be amorphous silicon thin film transistor, or polycrystalline or crystal thin film transistor, and the transistor may be an inverted-staggered type that a gate is firstly formed on an insulating substrate.

The OLED display device according to the present invention may include a scan line driving circuit configured to apply sequentially a selecting signal or a non-selecting signal to a plurality of scan lines; a data line driving circuit configured to apply a voltage corresponding to image information to a plurality of data lines; and a pixel circuit arranged in each point where the scan lines and the data lines are intersected.

Figure 6A:
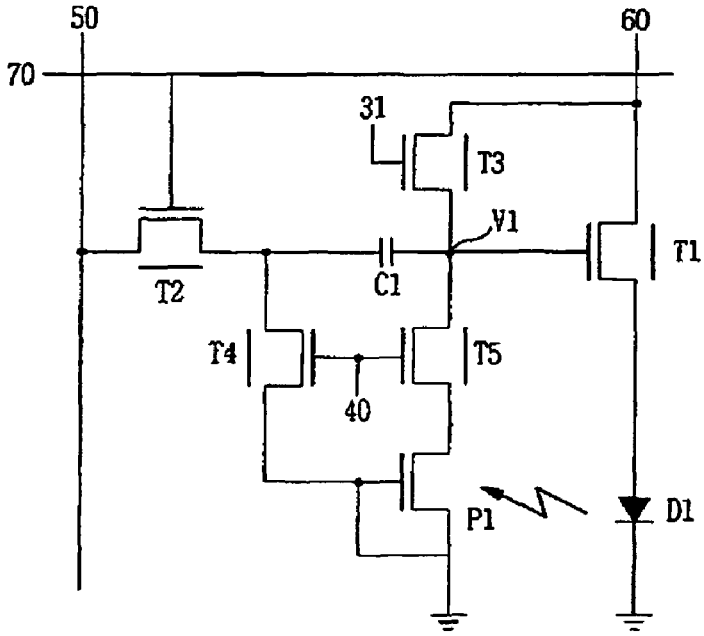
FIG. 6A is a diagram illustrating the constituents of a compensating pixel circuit using an optical feedback according to an active matrix method according to one example embodiment of the present invention.

FIG. 6A is a diagram illustrating an optical feedback type compensating circuit included in an OLED display device according to one example embodiment of the present invention.

As shown in FIG. 6A, the pixel circuit included in the OLED display device is composed of NMOS transistors T1, T2, T3, T4 and T5, an photo sensor P1, a capacitor C1, and an organic light emitting diode D1.

A cathode terminal of the OLED D1 is connected to a ground, and an anode terminal thereof is connected to the source terminal of the first transistor T1.

The drain terminal of the first transistor T1 of which the source terminal is connected to the anode terminal of the OLED is connected to a power supply 60, and applies a current to the OLED according to an applied voltage.

A gate terminal of the first transistor T1 is connected to a source terminal of the third transistor T3, a drain terminal of the fifth transistor and the capacitor C1.

A drain terminal of the third transistor T3, of which a source terminal is connected to the gate terminal of the first transistor T1, is connected to the power supply 60 and the drain terminal of the first transistor T1, and a gate terminal the third transistor T3 is connected to the first scan line of the former terminal (i.e., $(N-1)^{th}$ first scan line) 31.

A gate terminal of the fifth transistor T5 of which a drain terminal is connected to the gate terminal of the first transistor T1 is connected to a second scan line (i.e. $N^{th}$ scan line) 40, and the source terminal of the fifth transistor T5 is connected to one terminal of the photo sensor P1. The embodiment of FIG. 6A uses the thin film transistor type photo sensor.

One terminal of the photo sensor is connected to the source terminal of the fifth transistor T5, and the other terminal thereof is connected to a common electrode.

One terminal of the capacitor C1, which is connected to the gate terminal of the first transistor T1, is connected to the source of the second transistor T2 and the drain terminal of the fourth transistor T4, and the other terminal thereof is connected to the gate terminal of the first transistor T1, the source terminal of the third transistor T3 and the drain terminal of the fifth transistor T5.

The gate terminal of the second transistor T2, to which one terminal of the capacitor C1 is connected, is connected to the first scan line (i.e., $N^{th}$ first scan line) 70, and the drain terminal thereof is connected to the data line 50. Accordingly, a voltage corresponding to luminance information applied from the data line 50 is transferred to the gate terminal of the first transistor T1 by a capacitance-coupling of the capacitor C1 via the second transistor T2 in order to control a current of the OLED.

The gate terminal of the fourth transistor, to which a drain terminal is connected to one terminal of the capacitor C1, is connected to the second scan line (i.e., $N^{th}$ second scan line) 40, and the source thereof is connected to the common electrode.

Figure 7:
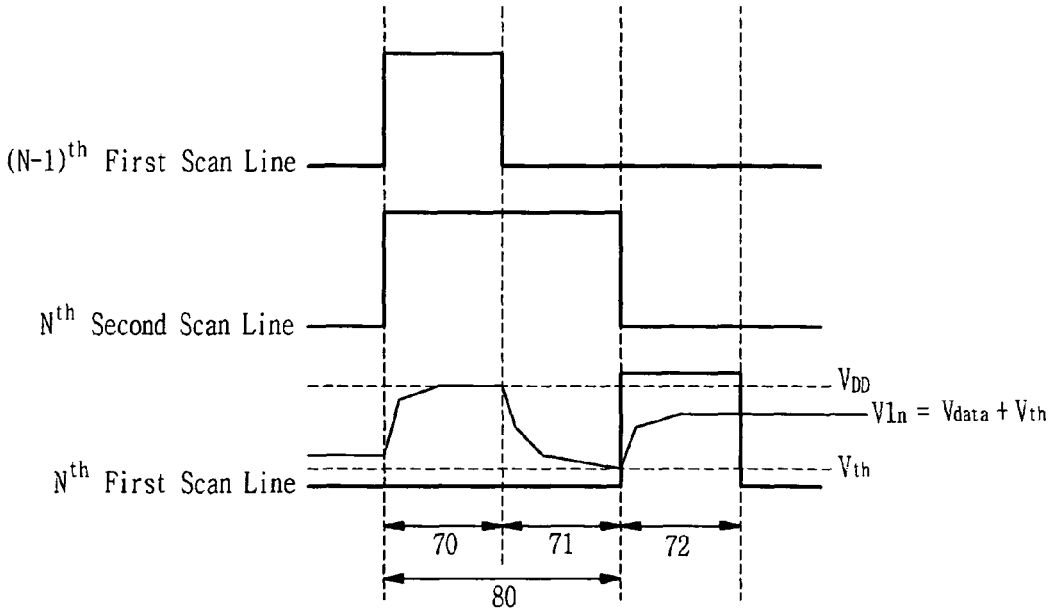
FIG. 7 is a timing chart explaining a driving operation of a compensating pixel circuit using an optical feedback according to an active matrix method according to an example embodiment of the present invention.

FIG. 7 is a timing chart explaining a driving operation of a compensating pixel circuit using an optical feedback according to an active matrix method according to an example embodiment of the present invention.

A driving method of the OLED display device may include a scan line driving circuit configured to apply sequentially a selecting signal or a non-selecting signal to a plurality of scan lines, a data line driving circuit configured to apply a voltage corresponding to image information to a plurality of data lines, and a pixel circuit arranged in each point where the scan lines and the data lines are intersected. The driving method will now be explained.

First, when an selecting signal is applied through the first scan line of the former terminal (i.e., $(N-1)^{th}$ first scan line), the third transistor is turned on by applying the selecting signal to the gate terminal of the third transistor T3, thereby increasing a pixel voltage V1. The fourth and fifth transistor are turned on by enabling the first scan line of the former terminal (i.e., $(N-1)^{th}$ first scan line) to be selected and simultaneously enabling the second scan line (i.e., $N^{th}$ second scan line) 40 to be selected.

When the first transistor T1 is turned on according as the pixel voltage is increased, the current applied from the power supply 60 flows through the OLED D1, and the OLED D1 emits light. A leak current of the photo sensor P1 is increased by emitting light from the OLED D1, and the pixel voltage is maintained to a constant voltage (i.e., region 70 of FIG. 7).

In this case, the third transistor T3 is turned off according as the non-selecting signal is applied to the first scan line of the former terminal (i.e., $(N-1)^{th}$ first scan line) 31. Then, the photo sensor P1 produces a photo current until the OLED is turned off, thereby lowering gradually the pixel voltage. When the non-selecting signal is applied to the second scan line 40, the pixel voltage is set to the gate terminal of the first transistor (region 71 of FIG. 7). The region 71 of FIG. 7 may be an optical feedback region, and a region that the voltage of the gate terminal of the first transistor T1 is stored when the OLED D1 is turned off.

In this state, the second transistor is turned on by enabling the second scan line 40 to be non-selected and enabling the selecting signal to be applied through the first scan line (i.e., $N^{th}$ second scan line) 70. Accordingly, a voltage $V_{data}$ corresponding to luminance information transmitted from the data line via the turned-on second transistor is transferred to the capacitor C1.

The voltage corresponding to the transferred luminance information causes the voltage of the gate terminal of the first transistor T1 to be varied by the capacitance coupling of the capacitor C1, and simultaneously is stored in the capacitor C1.

The first transistor T1 is turned on according as the voltage corresponding to the luminance information is applied to the gate terminal of the first transistor T1. The current applied from the power supply 60 flows constantly to the OLED via the first transistor T1. The OLED emits light by the current flowing constantly to the OLED (region 72 of FIG. 7).

In this state, even when the non-selecting signal is applied to the first scan line (i.e., $N^{th}$ first scan line) 70, the constant current is flown to the OLED for 1 frame period. In other words, by the voltage stored in the capacitor C1, the voltage of the gate terminal of the first transistor T1 is constantly maintained for 1 frame period, and thus the current flowing to the OLED is also constantly maintained.

The pixel voltage Vln for the 1 frame period is to add a voltage $V_{th}$ set to the gate terminal of the first transistor while turning off the OLED to a voltage Vita corresponding to luminance information transmitted through the data line.

As described above, the OLED display device and the driving method thereof use the thin film transistor type as the photo sensor included in the pixel circuit.

Figure 6B:
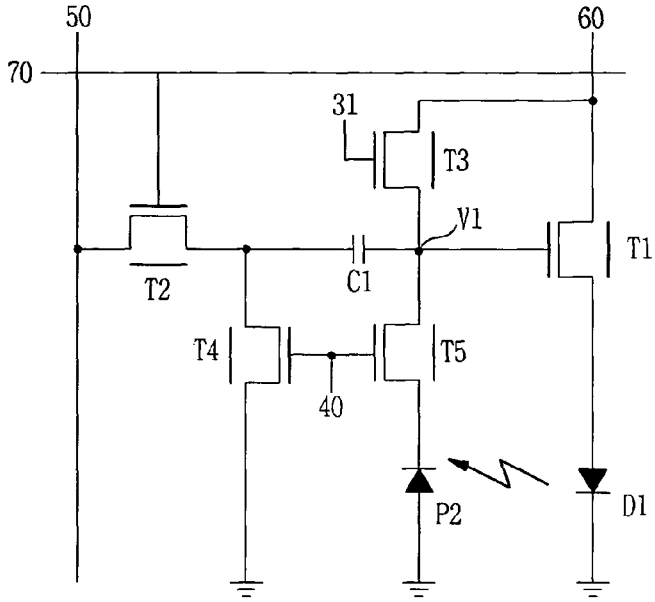
FIG. 6B is a diagram illustrating the constituents of a compensating pixel circuit using an optical feedback according to an active matrix method according to another example embodiment of the present invention.

FIG. 6B shows a pixel circuit for compensating an optical feedback using P-i-N photo diode P2 as the photo sensor.

Since the OLED display device and the driving method thereof as shown in FIG. 6B is the same embodiment as that using the above-described thin film transistor type photo sensor P1, the explanation will be omitted.

The active matrix type OLED display device having the compensating circuit using the optical feedback according to the present invention senses a final output, i.e. brightness of light of the pixel, and voluntarily controls the brightness of the pixel. Accordingly, the OLED display device can obtain the quality of the image which the brightness of the pixel is not varied according to the signal, even when a usage time of the display device is increased and the threshold voltage and the mobility are varied.

As described above, according to the preferred embodiments of the present invention, the OLED display device can constantly obtain luminance of the light emitting elements by elapsed time, because the brightness of the pixel for the signal voltage is not varied by a characteristic variance of the transistor (e.g., a driving element) and the OLED. Accordingly, the OLED display device according to the present invention can minimizes the variance of the pixel brightness due to deterioration of the transistor and the OLED produced by usage for a long time and increase life span of the display device.

Further, the OLED display device can display high quality of the image even in case of the high precision display, because it is controlled to flow the current to OLED included in each pixel.

Further, the OLED display device can have very long life span in comparison with other OLED display device, and thus be variously applied to a science field and a commercial field.

While the example embodiments of the present invention and their advantages have been described in detail, it should be understood that various changes, substitutions and alternations may be made herein without departing from the scope of the invention.

What is claimed is:

1. An OLED display device including a scan line driving circuit configured to apply sequentially a selecting signal or a non-selecting signal to a plurality of scan lines; a data line driving circuit configured to apply a voltage corresponding to image information to a plurality of data lines; and a pixel circuit arranged in each point where the scan lines and the data lines are intersected, wherein the pixel circuit comprises:

an OLED having two terminals;

a first transistor of which a source terminal is connected to an anode terminal of the OLED without any intervening connections to other terminals of the first transistor and the OLED, and a drain terminal is connected to a power supply without any intervening connections to other terminals of the first transistor, for providing a current to the OLED according to an applied voltage;

a second transistor of which a gate terminal is connected to an $N^{th}$ first scan line and a drain terminal is connected to the data line;

a third transistor of which a drain terminal is connected to the drain terminal of the first transistor and the power supply without any intervening connections to other terminals of the first and third transistors, and a gate terminal is connected to an $(N-1)^{th}$ first scan line, and a source terminal is connected to the gate terminal of the first transistor without any intervening connections to other terminals of the first and third transistors;

a fourth transistor of which a drain terminal is connected to the source terminal of the second transistor, a source terminal is connected to a common electrode, and a gate terminal is connected to an $N^{th}$ second scan line;

a fifth transistor of which a drain terminal is connected to the gate terminal of the first transistor without any intervening connections to other terminals of the first and fifth transistors and the source terminal of the third transistor without any intervening connections to other terminals of the third and fifth transistors, and a gate terminal is connected to the $N^{th}$ second scan line and the gate terminal of the fourth transistor without any intervening connections to other terminals of the fourth and fifth transistors;

a capacitor of which one terminal is connected to the gate terminal of the first transistor, the source terminal of the third transistor and the drain terminal of the fifth transistor, and the other terminal is connected to the source terminal of the second transistor and the drain terminal of the fourth transistor; and a photo sensor of which one terminal is connected to the source terminal of the fifth transistor, and the other terminal is connected to the common electrode.

2. The OLED display device of claim 1, wherein the photo sensor may be a thin film transistor type photo sensor using a photo leak current of the thin film transistor.

3. The OLED display device of claim 1, wherein the photo sensor may be a photodiode.

4. The OLED display device of claim 2, wherein the transistors may be amorphous silicon thin film transistor.

5. The OLED display device of claim 2, wherein the transistors may be a polycrystalline or crystal thin film transistor.

6. The OLED display device of claim 2, wherein the transistors may be an inverted-staggered type that a gate is firstly formed on an insulator substrate.

7. The OLED display device of claim 2, wherein the transistors may be NMOS type.

8. The OLED display device of claim 2 or 3, wherein the photo sensor may be formed of amorphous silicon.

9. A driving method of an OLED display device including a scan line driving circuit configured to apply sequentially a selecting signal or a non-selecting signal to a plurality of scan lines; a data line driving circuit configured to apply a voltage corresponding to image information to a plurality of data lines; and a pixel circuit arranged in each point where the scan lines and the data lines are intersected, comprising:

enabling the selecting signal to be transmitted to a gate terminal of a third transistor via an $(N-1)^{th}$ first scan line and the third transistor to be turned on to increase a pixel voltage V1, and enabling a fourth and fifth transistor to be turned on accordingly as the $(N-1)^{th}$ first scan line and an $N^{th}$ second scan line are simultaneously selected;

enabling a first transistor to be turned on and causing the OLED to emit light by increasing the pixel voltage and enabling the pixel voltage to maintain a constant voltage accordingly as a leak current of a photo sensor is increased when the selecting signal is applied to the $(N-1)^{th}$ first scan line and the $N^{th}$ second scan line;

enabling the third transistor to be turned off by applying the non-selecting signal to the $(N-1)^{th}$ first scan line, enabling the photo sensor to produce a photo current until the OLED is turned off so as to decrease gradually the pixel voltage, and setting the pixel voltage, when the non-selecting signal is applied to the second scan line, to the gate terminal of the first transistor;

enabling the second transistor to be turned on by applying the selecting signal via an $N^{th}$ first scan line, storing a voltage $V_{data}$ corresponding to luminance information transmitted from the data line via the turned-on second transistor and simultaneously varying the voltage of the gate terminal of the first transistor; and enabling the first transistor to be turned on accordingly as the voltage is applied to the gate terminal of the first transistor and emitting light from the OLED by flowing constant current to the OLED when the selecting signal is applied to $N^{th}$ first scan line, and the non-selecting signal is applied to the $(N-1)^{th}$ first scan line and the $N^{th}$ second scan line.

10. The driving method of claim 9, wherein the photo sensor may be a thin film transistor type photo sensor using a photo leak current of the thin film transistor or photo diode.

11. The driving method of claim 9, wherein after the non-selecting signal is applied to the $N^{th}$ first scan line, the voltage of the gate terminal of the first transistor and the current flowing to the OLED are constantly maintained by the voltage stored in the capacitor for 1 frame period.

12. The driving method of claim 11, wherein the pixel voltage V1 for the 1 frame period is to add a voltage $V_{th}$ set to the gate terminal of the first transistor while turning off the OLED to a voltage $V_{data}$ corresponding to luminance information transmitted through the data line.

* * * * *